US005516580A

United States Patent [19]

Frenette et al.

[11] Patent Number: 5,516,580

[45] Date of Patent: May 14, 1996

[54] CELLULOSIC FIBER INSULATION MATERIAL

[75] Inventors: Daniel Frenette, Iles Laval; Berthier Roy, Danville; Serge Cadieux, Pierrefonds; Michel Labbé, Arthabaska; Stéphane St-Cyr, Trois-Rivieres West., all of Canada

[73] Assignees: Groupe Laperriere et Verreault Inc., Trois-Rivières; Cascades Inc., Kingsey-Falls, both of Canada

[21] Appl. No.: 417,732

[22] Filed: Apr. 5, 1995

[51] Int. Cl.[6] ..... D04H 1/58

[52] U.S. Cl. ..... 428/288; 428/297; 428/296; 428/359; 428/360

[58] Field of Search ..... 428/357, 359, 428/360, 373, 288, 297, 296

[56] References Cited

U.S. PATENT DOCUMENTS

| | | | |
|---|---|---|---|
| 4,160,059 | 7/1979 | Samejima | 428/288 |
| 4,692,363 | 9/1987 | Reiss et al. | 428/297 |
| 4,795,668 | 1/1989 | Krueger et al. | 428/373 |
| 5,023,131 | 6/1991 | Kwok | 428/288 |
| 5,167,764 | 12/1992 | Nielsen et al. | 428/297 |
| 5,240,764 | 8/1993 | Haid et al. | 428/288 |
| 5,272,000 | 12/1993 | Chenoweth et al. | 428/297 |
| 5,380,580 | 1/1995 | Rogers et al. | 428/288 |
| 5,418,031 | 5/1995 | English | 428/905 |

*Primary Examiner*—N. Edwards

[57] ABSTRACT

An insulating material is described and comprised of loose fill short cellulose fibers and bonding synthetic fibers. The synthetic fibers are of longer length than the short cellulosic fibers and have an outer sheath which is heat-fused with outer sheaths of other synthetic fibers at crossing contact points thereof to form a matrix having pockets for retaining the loose fill cellulosic fibers therein and throughout the matrix thereby eliminating the need of an adhesive binder to retain the cellulose fibers in the matrix. The matrix can form a body having the shape of a batt of insulation and the batt may be provided with a facing sheet of suitable vapor permeability.

23 Claims, 4 Drawing Sheets

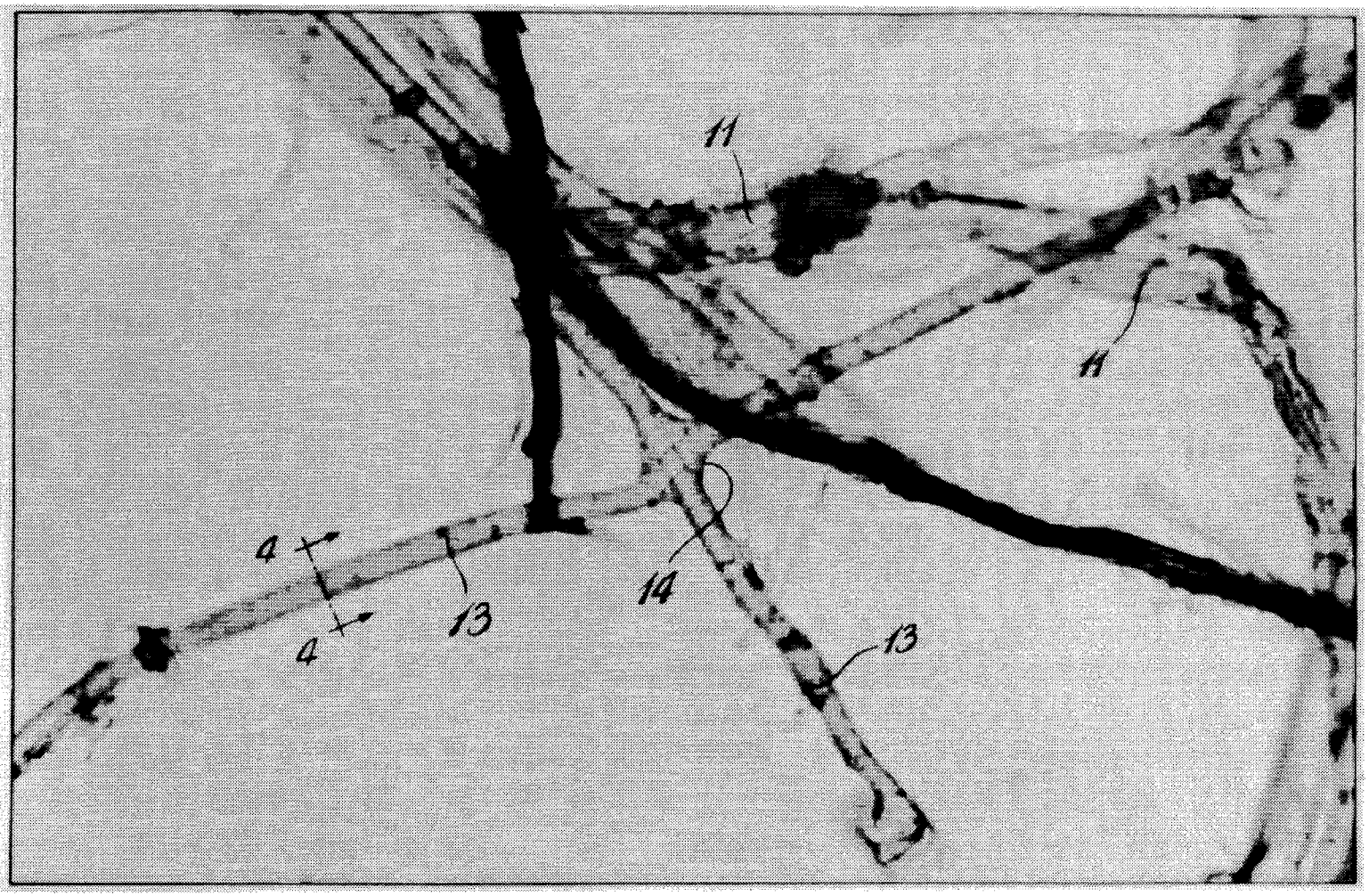
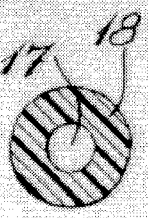
Fig. 4
Fig. 3

CELLULOSIC FIBER INSULATION MATERIAL

TECHNICAL FIELD

The present invention relates to an insulating material which is comprised of loose fill short cellulosic fibers retained in a matrix formed by bondable synthetic fibers which are heat-fused together at crossing contact points to form pockets in the matrix in which the cellulosic fibers are trapped without the use of any adhesive binder.

BACKGROUND OF THE INVENTION

Fiberglass batts are well known in the art of insulation and are commonly produced with glass fibers and an aqueous thermosetting resin. The aqueous thermosetting resin is applied on the glass fibers and dried and cured in a forced air oven whereby to bind the fibers together in a batt. Facings such as kraft paper, aluminum foil, etc., are sometimes bonded with a suitable adhesive to the batt after the oven.

One of the disadvantages of this process is that since large volume of air are required to form and cure the batt, it is difficult to control the emission by the binder of toxic gases and aerosols in the air. Furthermore, the heat required to evaporate the water and cure the binder on the batt constitute an expensive means of fabrication.

It is known in the art that cellulosic fibers can provide good insulating properties. To this end, ground recycled paper or virgin pulp are readily available. However, a disadvantage of the use of these products has been the fact that the fibers or bundles of fibers are very short, normally 1 to 10 mm as compared to fiberglass fibers which are in the range of about from 25 to 75 mm. As a result of this short length, a large quantity of liquid binder would be required to bind the fibers together in order to make a cellulosic batt with adequate integrity and this would not be economically feasible. Furthermore, the water used with the binder is undesirable due to the great affinity that the cellulose fibers have to water as compared to fiberglass. This would lead to an increase in the drying time and therefore an increase in the cost. There is therefore a need to find a means to fabricate a batt of cellulosic pulp using an appropriate binder and which could eliminate the problems associated with a liquid binder.

The use of dry binders, such as thermosetting or thermoplastic powders would eliminate the use of water and problems associated therewith. However, these powders must be utilized in large quantities in order to permit the fabrication of batts having an adequate integrity. Such large quantities of binder would not again be economically feasible.

Thermal bonding techniques can be used to bond fibers in a wide variety of nonwoven products such as filters, absorbents and clothing. This process utilizes thermoplastic fibers that bind together with heat. Such fibers will become tacky while preserving their shape at a predetermined temperature. Examples of such fibers are copolymers of vinyl acetate and vinyl chloride which is known under the trade mark WACKER MP FASER and also bicomponents fibers which are known under the trade mark CELBOND. "CELBOND" fibers are fibers manufactured with a high melting point (approximately 240° C.) polyester core and a lower melting point polyester or polyolefin sheath. Several grades are available with sheath melting points in as range of 110° to 200° C.

SUMMARY OF THE INVENTION

We have discovered that a cellulosic batt can be fabricated by utilizing these fibers instead of conventional binders. These thermoplastics fibers can be mixed with the cellulose fibers in desirable proportional and then bound together by heat. The bonds will form a tridimensional structure (matrix) with cells, which will trap the short cellulosic fibers therein without the use of binder. Experimentation has shown that this technique offers many advantages and necessitates only a small quantity of these binding fibers. By fabricating such a product no adhesive binder is necessary and therefore there is no emission of aerosols or other chemicals which pollute the air. It is also more economical to fabricate insulation in this manner and it results in a new use for recycled pulp, particularly ONP cellulose which is fabricated from recycled newsprint. The insulation can be used for thermal and acoustical applications.

According to the above features of the present invention there is provided, from a broad aspect, an insulating material which is comprised of loose fill short cellulosic fibers and bonding synthetic fibers. The synthetic fibers are of longer length than the short cellulosic fibers and heat-fused with the outer sheath of other synthetic fibers have an outer sheath which is at crossing contact points thereof to form a matrix having pockets which retains the loose fill cellulose fibers throughout a body formed by the matrix and thereby eliminates the need of adhesively binding the cellulose fibers.

According to another broad aspect of the present invention there is provided an insulating batt formed from this composition of loose fill short cellulosic fibers and bonding longer synthetic fibers treated as above-mentioned.

BRIEF DESCRIPTION OF DRAWINGS

A preferred embodiment of the present invention will now be described with reference to the accompanying drawings in which:

FIG. 3 is an extra magnification view showing two synthetic fibers bonded together at crossing contact points, FIG. 4 is a cross-section view of a synthetic fiber as used to form the binding matrix.

DESCRIPTION OF PREFERRED EMBODIMENTS

Figure 1:
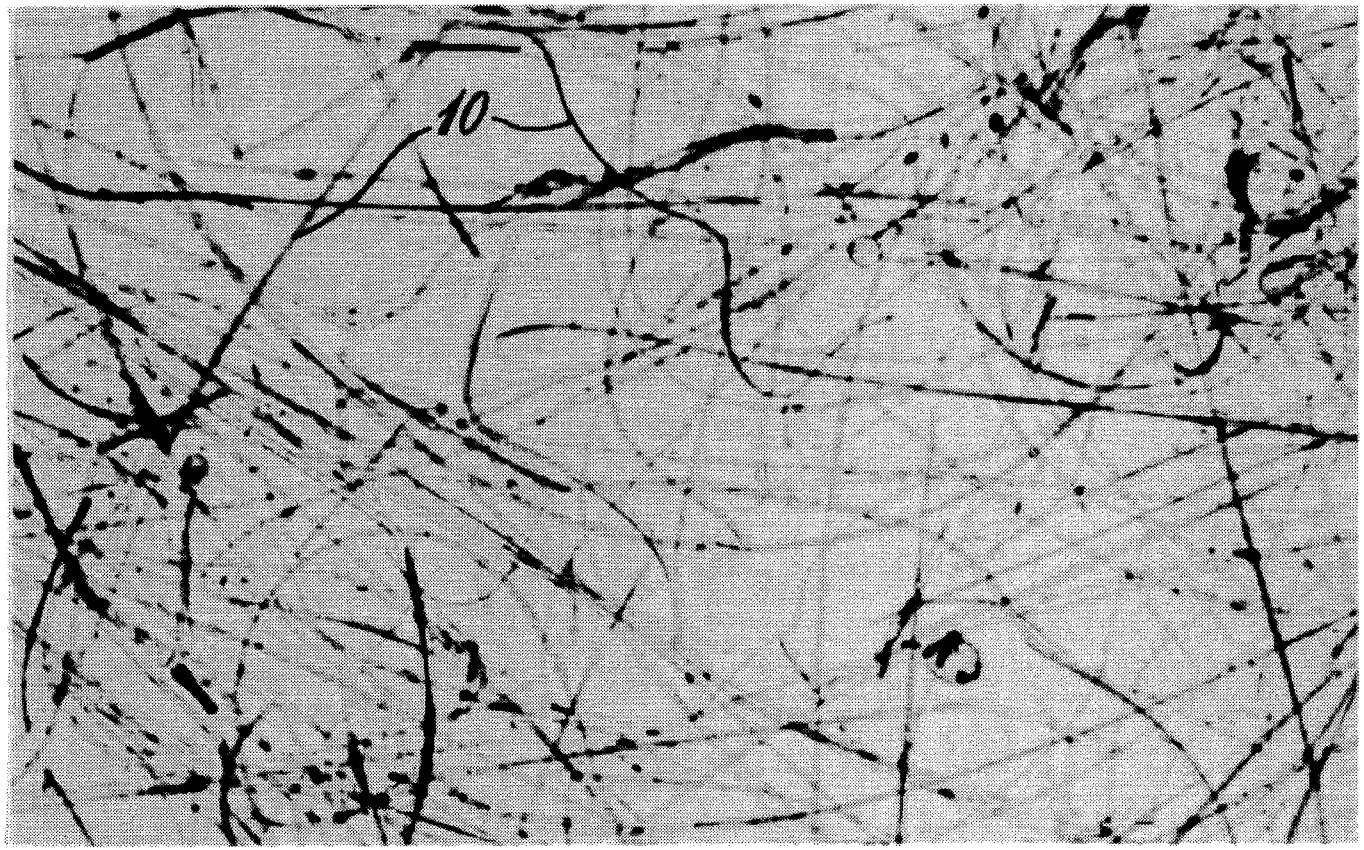
Fig. 1 (PRIOR ART)
FIG. 1 is a magnification view of fiberglass bonded together by an adhesive binder to form a fiber glass insulating batt, as is known in the prior art.

As shown in FIG. 1, long fiberglass fibers 10, in the range of 25 to 75 mm, are treated with a liquid binder whereby to form batts by subjecting the fibers and binders to a drying and curing process in a forced air oven. As previously mentioned this is a costly process and it produces the emission of aerosol in the air which pollutes the environment. The resin is typically a thermosetting water-based phenol formaldehyde resin. The fiberglass fibers have a diameter of approximately 3 to 10 microns.

Figure 2:
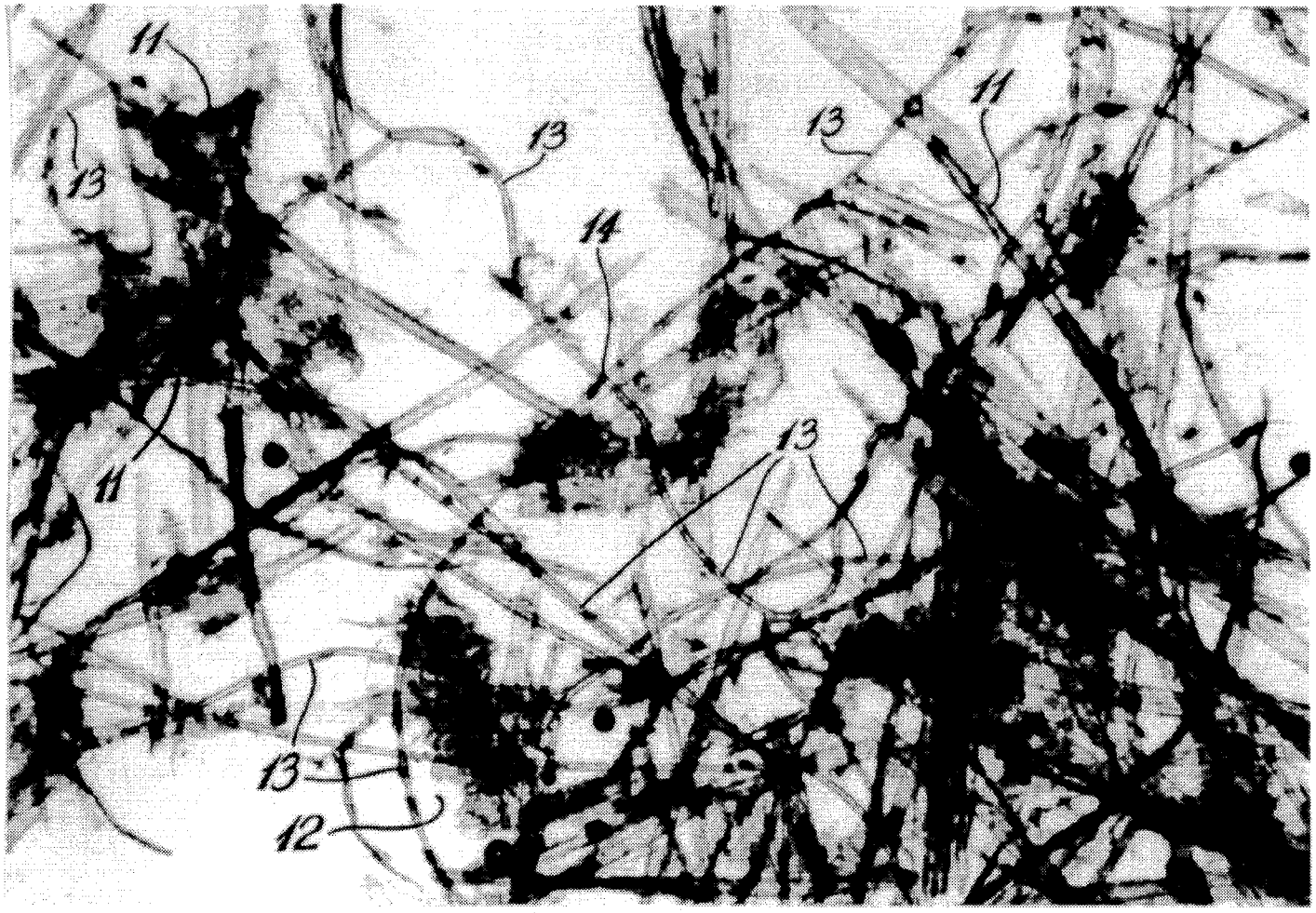
FIG. 2 is a magnification view showing the insulating material of the present invention comprised of loose fill short cellulosic fibers and a matrix of bonding synthetic fibers which form pockets to retain the short cellulosic fibers to form an insulating cellulosic fiber batt.

FIGS. 2 and 3 illustrate the fabrication of the insulating material of the present invention which comprises loose fill short cellulosic fibers 11 trapped in a binding matrix formed by longer synthetic fibers 13 which bind together at their crossing contact points such as 14 to form pockets 12 which trap the short cellulosic fibers. The short cellulosic fibers 11 have a length of from about 1 mm to about 4 mm, and a diameter of between 15 to 40 microns. The long bonding synthetic fibers are much longer and have a length which is more than 4 mm and preferably, but not exclusively, longer than 25 mm. These synthetic fibers are of the type that become tacky without loosing their shape at a predetermined temperature. FIG. 4 shows a cross section of a bicomponent fiber with a core 17 which has a higher melting point than its outer sheath. The synthetic fibers are mixed with the short cellulosic fibers 11 at a level by weight of 3% to 20% and preferably 5% to 8%, and subjected to a heating process wherein the outer sheath 18, and not the core 17, become tacky, with minimum shrinkage. An example of such fibers would comprise bicomponents thereof which are sold by Hoechst Celanese Corp. under the trade mark CELBOND.

The longer synthetic bonding fibers 13 also have a diameter which is approximately the same as the fiberglass fibers of the prior art, above described. The synthetic fibers 13 may also be of another type than bicomponents provided that they become tacky without loosing their shape at a predetermined temperature. An example is vinyl chloride-vinyl acetate copolymer fiber sold under the trade name WACKER MP FASER. It is therefore important that during the bonding process, to fabricate the insulating material of the present invention, that the mixture of the synthetic fibers and cellulose fibers be subjected to a predetermined temperature whereby the strength and length of the synthetic fibers is not effected but only sufficient to soften the polyester sheathing 18 to cause it to soften and bond at crossing contact points to form a matrix body of interconnected synthetic fibers which forms pockets to trap the loose short cellulosic fibers and thereby retain them in a body or batt having a specific shape.

Figure 5:
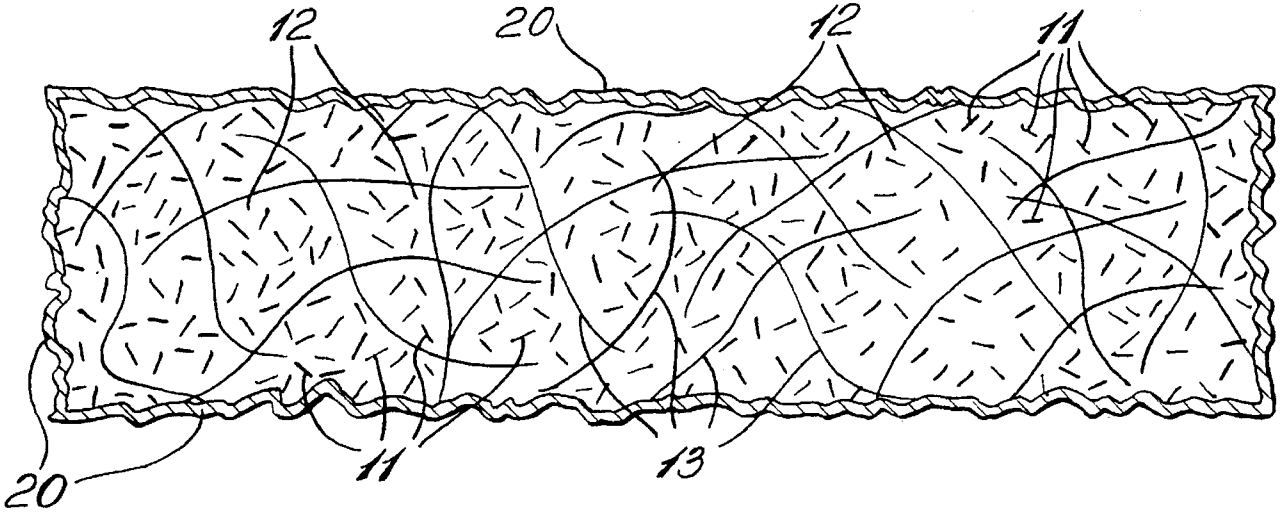
FIG. 5 is a cross-view of an unfaced insulating batt wherein the exterior surfaces thereof have been coated to reduce the release of dust particles.
Figure 6:
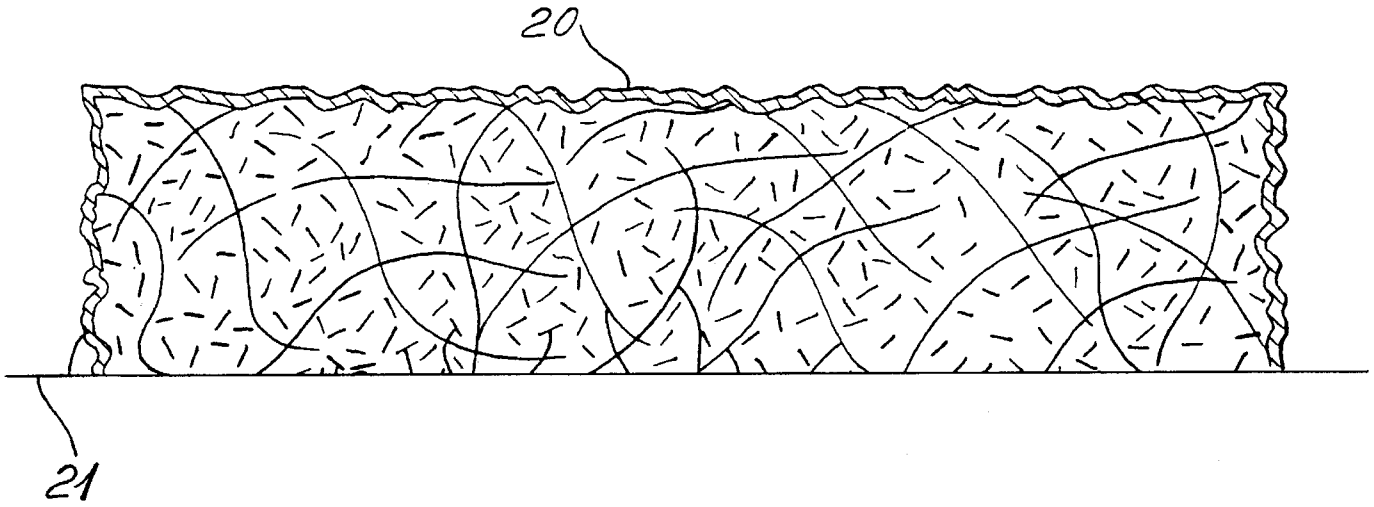
FIG. 6 is a cross-section view of a faced insulating batt wherein the extension surfaces thereof have been coated to reduce the release of dust particles.

It is also desirable when providing thermal or acoustical insulation batts formed with this insulating pulp to add a fire retardant chemical such as borax, boric acid, ammonium sulphate or aluminum sulfate or any other suitable chemical. Levels of fire retardant are typically 10 to 30% and preferentially 15% to 25%. As shown in FIG. 5, suitable coatings can be used to reduce the level of dust released in the handling of the batts. The preferred coatings are greases and can be formulated from a broad range of chemicals such as hydrocarbons, fatty acids and silicones. The product can also be provided in sheet, thin mats or roll form and may be faced with a suitable facing sheet 21 which is well known in the art to meet specific construction practice. The facing sheet may be comprised of aluminum foil, kraft paper, cellulosic scrim, polyethylene film or any other material, as required. The batt, can of course, be an unfaced insulating batt of rectangular cross-section.

The cellulose fibers may be short virgin fibers or else recycled paper such as ONP cellulose fibers fabricated from old newsprint. It can also be long cellulose fibers such as cotton, wood fibers, jute or linen. The wood fibers are produced by coarse refining of wood chips. Still further the cellulose fibers may be derived from "so-called" urban wood which comprise recycled pallets, wood cuttings from construction sites, etc.

A mix of two or more cellulose fibers can also be used to optimize the desired characteristics of a product. For instance, jute can be used to reduce the density of an ONP batt. In one experiment, a level of 15% of jute reduced the density of a 2 lb/cu.ft batt to a value of 1.5 lb/cu.ft. A lower density is economically beneficial.

It is within the of the present invention to provide any other obvious modifications of the preferred embodiment described herein, provide such modifications fall within the scope of the appended claims.

We claim:

1. An insulating material comprised of loose fill short cellulose fibers and longer bonding synthetic fibers, said synthetic fibers being of longer length than said short cellulose fibers, said bonding synthetic fibers having an outer sheath which is heat-fused with outer sheaths of other synthetic fibers at crossing contact points thereof to form a matrix having pockets for retaining said loose fill cellulose fibers therein and throughout said matrix thereby eliminating the need of an adhesive binder to retain said cellulose fibers in said matrix.

2. An insulating material as claimed in claim 1 wherein said cellulosic fibers have a length of from about 1 mm to about 10 mm.

3. An insulating material as claimed in claim 2 wherein said bonding synthetic fibers have a length longer than 10 mm.

4. An insulating material as claimed in claim 2 wherein said bonding synthetic fibers have a length longer than 25 mm, said synthetic fibers being a bicomponent fiber comprised of a core and an outer sheathing, said outer sheating having a melting point lower than said polyester core, said outer sheathing becoming tacky without loosing its shape, when exposed to a predetermined temperature in the range of 110° to 200° C.

5. An insulating material as claimed in claim 2 wherein said bonding synthetic fibers have a length longer than 25 mm, said synthetic fibers being a copolymer of vinyl chloride and vinyl acetate which will become tacky without loosing its shape, when exposed to a predetermined temperature.

6. An insulating material as claimed in claim 4 wherein said material is a thermal insulating material, there being further provided a fire-retardant chemical such as, without limitation, Borax, Boric Acid, Ammonium sulphate or aluminum sulfate mixed with said fibers.

7. An insulating batt comprising a blend of loose fill short cellulose fibers and longer bonding synthetic fibers, said bonding synthetic fibers having an outer sheath which is heat-fused with outer sheaths of other synthetic fibers at crossing contact points thereof to form a matrix having pockets for retaining said loose fill cellulose fibers therein and throughout said matrix thereby eliminating the need of an adhesive binder to retain said cellulosic fibers in said matrix.

8. An insulating batt as claimed in claim 7 wherein said cellulosic fibers have a length of from about 1 mm to about 10 mm.

9. An insulating batt as claimed in claim 8 wherein said bonding synthetic fibers have a length longer than 25 mm and having a core and an outer sheathing, said outer sheathing having a melting point lower than said core, said outer sheathing becoming tacky without loosing its shape when exposed to a predetermined temperature.

10. An insulating batt as claimed in claim 9 wherein said material is a thermal insulating material, there being further provided a fire-retardant chemical such as, without limitation, Borax, Boric Acid, Ammonium sulphate or aluminum oxide mixed with said fibers.

11. An insulating batt as claimed in claim 9 wherein said batt is further provided with a facing sheet.

12. An insulating batt as claimed in claim 11 wherein said facing sheet is comprised of an aluminum foil, kraft paper, cellulosic scrim, polyethylene film or and other material as required.

13. An insulating batt as claimed in claim 9 wherein said batt is an unfaced insulation batt.

14. An insulating material or batt as claimed in claim 1 wherein said short cellulose fibers and made from recycled cellulose fibers.

15. An insulating material or batt as claimed in claim 1 wherein said short cellulose fibers are made from virgin fibers.

16. An insulating material or batt as claimed in claim 1 wherein said cellulose fibers are made from cotton fibers.

17. An insulating material or batt as claimed in claim 1 wherein said cellulose fibers are made from wood fibers.

18. An insulating material or batt as claimed in claim 1 wherein said insulation material or batt is a thermal insulation.

19. An insulating material or batt as claimed in claim 1 wherein said insulation material or batt is an acoustical insulation.

20. An insulating batt as claimed in claim 7 wherein said batt is provided with a greasy coating on exterior surfaces thereof to trap said short cellulose fibers in said batt whereby to reduce dust particles from being released from said batt during manipulation thereof.

21. An insulating material as claimed in claim 1 wherein two or more types of cellulose fibers are used to reduce the density of said material.

22. An insulating material or batt as claimed in claim 1 wherein said cellulose fibers are made from urban wood fibers.

23. An insulating material or batt as claimed in claim 20 wherein said greasy coating is selected among greases formulated with hydrocarbons, fatty acids and silicones.

* * * * *